US005457922A

United States Patent [19]

Fara

[11] Patent Number: 5,457,922

[45] Date of Patent: Oct. 17, 1995

[54] APPARATUS AND METHOD FOR REMOVING STRUCTURAL PARTS OF A BUILDING WITHOUT CONTAMINATING ADJACENT AREAS

[76] Inventor: Mark C. Fara, 11803 Browningsville Rd., Monrovia, Md. 21770

[21] Appl. No.: 314,942

[22] Filed: Sep. 29, 1994

[51] Int. Cl.[6] ..... E04G 21/24

[52] U.S. Cl. ..... 52/202; 52/DIG. 12; 52/127.2; 52/745.15; 312/1; 312/245

[58] Field of Search ..... 52/DIG. 12, 202, 52/514, 127.1, 127.2, 745.15, 745.16; 49/61; 312/1, 245, 247

[56] References Cited

U.S. PATENT DOCUMENTS

| | | | |
|---|---|---|---|
| 2,195,361 | 3/1940 | Davis | 49/61 X |
| 3,323,851 | 6/1967 | Duboff | 312/247 |
| 4,193,232 | 3/1980 | Almsted et al. | 52/98 |
| 4,221,091 | 9/1980 | Ganse et al. | 52/202 |
| 4,389,827 | 6/1983 | Van Valkenburg | 52/202 X |
| 4,865,401 | 9/1989 | Jacobson | 312/1 X |
| 4,911,191 | 3/1990 | Bain | 312/1 X |
| 5,201,152 | 4/1993 | Heffner | 52/64 |

FOREIGN PATENT DOCUMENTS

| | | | |
|---|---|---|---|
| 2409447 | 7/1979 | France | 52/202 |
| 2411282 | 8/1979 | France | 52/DIG. 12 |
| 268361 | 5/1989 | Germany | 52/DIG. 12 |

*Primary Examiner*—Carl D. Friedman
*Assistant Examiner*—Laura A. Saladino
*Attorney, Agent, or Firm*—Leonard Bloom

[57] ABSTRACT

The invention is directed to a containment box for use during window frame removal or other building structure modification to prevent toxic material from entering the environment; and particularly inhabited areas of the building.

16 Claims, 8 Drawing Sheets

APPARATUS AND METHOD FOR REMOVING STRUCTURAL PARTS OF A BUILDING WITHOUT CONTAMINATING ADJACENT AREAS

FIELD OF THE INVENTION

The invention relates to apparatus and methods used to remove structural parts of a building without contaminating the area surrounding the building or the inhabited living areas of the building.

BACKGROUND OF THE INVENTION

There is a need in the art for structurally modifying inhabited building structures without substantial inconvenience and disruption to the normal activity of the residents of the building.

In recent years the public has been made aware of toxicity to our environment. For example, air pollution by automobile exhaust gases and industrial emissions; polluted lakes and streams due to water run-off carrying fertilizers, insecticides and strip-mined coal residue; and pollution in the home due to lead and asbestos, are all pollutants well known to the ordinary citizen. Infants and young children are most at risk due to lead exposure. Lead exposure can seriously injure the child's brain and nervous system.

Lead based paint pollution is a major public hazard. The hazardousness of lead based paint has been recognized by the U.S. Government. The Department of Housing and Urban Development has issued guidelines for dealing with lead-based paint hazard identification and abatement in public housing.

The federal government has mandated lead abatement in public housing project modernization. Before undertaking such abatement projects, personnel are to be trained as to aspects of safety. Procedures are to be instituted to minimize lead pollution affecting both the workers and the environment. The need to wear protective clothing is a must, e.g., gloves, masks, eye protection, etc.

When removing lead-contaminated structures, measures for controlling debris and lead dust must be instituted. The work area must be enclosed and toxic material disposed of with care. Workers must wear properly fitted respirators. Protective clothing, such as, protective overalls, disposable shoe covers, gloves, hats and goggles must be worn at all times. Care must be taken to effectively dispose of contaminated work clothing. Workers must shower to remove residual lead dust contamination.

All movable furniture, draperies should be moved out of the work area. If carpeting is to be left in place, it must be covered with two sheets of 6 mil polyethylene sheeting secured to the walls or baseboard with masking tape. Furniture left in the work area must be covered with plastic and sealed with tape. In some instances an entire area of a room is to be sealed off with tape and polyethylene sheeting running from wall to wall and floor to ceiling. All tears in plastic must be immediately repaired.

As can be seen from the above exposition of facts, the removal of lead contamination from existing building structures is no easy task.

Prior art U.S. Patents show the state of the art.

Almstead et al in U.S. Pat. No. 4,193,232 discloses a window cap for sealing a window to conserve energy. The device is pan-like with edges which can be attached to the building structure to keep cold air from entering the building through the windows.

U.S. Pat. No. 4,221,091 to Ganse et al discloses an insulation system for windows with the insulation panels placed in brackets on the inside walls.

A containment device for contaminated building demolition is taught by Heffner in U.S. Pat. No. 5,201,152. The Heffner containment device is designed to surround an entire building. The device is made of a rigid steel frame, covered with a flexible fabric or plastic sheet material, and moves on railroad tracks from place to place.

None of the prior art containment devices describe a containment box surrounding a work area, attached to the floor and ceiling of a room and having a seal between the containment box and wall to prevent contamination of inhabited areas during building structure modification.

SUMMARY OF THE INVENTION

The invention herein disclosed addresses the problem of pollution and inconvenience to residents of homes and offices being remodeled. The invention is particularly concerned with the removal of lead contaminated windows and window frames in occupied buildings. Lead contaminated window frame removal presents an environmental problem, not only due to lead which might pollute the environment, but also due to dust pollution.

The present commercial method used by environmental contractors is to build an enclosure out of 6 mil. poly film. This enclosure is about 6' away from the wall where the window (or windows) are located and provides an enclosure for the personnel who are removing the window and its frame. The poly film enclosure prevents also dust and debris from entering living areas. It goes without saying that this method is inefficient because of the length of time that it takes to make such an enclosure. Moreover, the plastic or poly film is subject to tearing or cutting and would require repair. To seal the enclosure against the wall, tape or a like material has to be used, which when removed from the wall leaves destructive marks on the paint or wall paper.

If the floor is carpeted, the carpet must be covered with plastic and sealed down by tape. Sealing with tape is difficult because the tape does not always effectively seal the carpet and furthermore, the tape seal could ruin the carpet. If the tape itself does not stick then a special spray glue has to be used, adding further to inconvenience. Finally, the poly film itself becomes contaminated and must be handled as a hazardous material and brought to a suitable landfill along with the removed window and its frame for disposal.

The heart of this invention is a containment box which facilitates the making of structural modifications to buildings and is particularly useful in expediting the removal of windows and window frames of existing buildings in an environmentally safe manner. The building living area can remain occupied while modifications are being made. Windows and frames of existing buildings must be removed, bearing in mind that they can be contaminated with several coatings of lead-based paint. In many instances there are so many coatings of lead paint on the windows that the windows have been painted shut.

The invention herein disclosed completely reverses the methodology employed by the prior art. Rather than working from inside the building to remove the contaminated window frame, the worker employing the methodology and containment box of this invention works from the outside.

To facilitate working from the outside, a containment box is placed on the inside wall surrounding the window or frame to be removed. This containment box is made of non-porous panels or tile boards (similar to those used in kitchens and baths) and the panels are completely sealed and closed so as to be substantially completely airtight. A gasket of foam or other suitable material is utilized around the periphery of the box to provide an airtight seal against the wall to accommodate any variations in the wall thickness or surface texture.

The containment box is provided with a jackscrew at its bottom to engage the floor and a brace at the top to engage the ceiling. The jackscrew cooperates with a floor pad; and the ceiling brace cooperates with a ceiling pad. The jackscrew works similarly to a turnbuckle; and using a ratchet wrench, one can quickly install the containment box. As a modification the ceiling brace can be replaced with a jackscrew such that adjustment is made by adjusting either jackscrew. While it is possible to place the jackscrew either at the top or bottom of the box, it is more convenient that the jackscrew be placed at the bottom of the box because no ladder or step-stool would be required to reach the jackscrew. In certain types of windows the containment box could sit on the floor and could be fixed to the ceiling by a jackscrew set on top of the box to brace against the ceiling. For added support an angled brace could be supplied to the back of the box to support the box against the wall. The brace could be simply kicked into place to further anchor the box against the wall. As alternative embodiments, the brace could be hinged to the back of the box, or could be telescopic.

Once the containment box is in place the workman can remove the window and its frame from the outside. The window and its frame, along with the glass, are discarded in a dumpster which is taken to a landfill for hazardous material disposal. Any residue which falls into the containment box is removed from the box and discarded into the dumpster. The removal of the window frame is facilitated by the use of crow bars and pinch bars. Of course these bars, as well as, other tools used in removal must, from time to time, be decontaminated.

As an alternative to the use of the dumpster, a pick up truck with an enlarged tailgate or high-lift (snorkel lift) is brought flush up against the building beneath the window to collect the chips and debris that are generated when the window and its frame are removed. These chips and debris are then vacuumed up and the bed of the pick-up truck and tailgate are "de-toxed" using the trisodium phosphate spray and rag-disposal clean-up method.

In the cleanup operation, detergents with high-phosphate content (5% TSP) are most effective. These high phosphate detergents contain trisodium phosphate (TSP). The inside of the containment box is cleaned using a detergent spray containing trisodium phosphate which has an affinity for lead. At times, a second spray may be required to ensure the complete removal of lead. After each spraying with trisodium phosphate, the spray is wiped off with a cloth or rag which has to be discarded along with the other toxic waste materials. Waste water from the cleanup is hazardous and should be treated accordingly.

Once the containment box is cleaned and detoxified, it can be moved to another window and reused. (This is not possible with poly film as used in the prior art.) With proper maintenance the containment box should have a long life.

The inventor in experiments has determined that the use of the containment box of this invention is much more efficient than the polyethylene plastic taping method. The containment box method takes fifteen minutes to remove a window, while the taping method takes over an hour and involves additional cleanup and structural repair time.

While the containment box has been described primarily in the context of removal of window frames it can be used to contain an area of the wall when part of the wall is to be removed. With modifications the containment box can be used where a door frame is to be replaced.

In a preferred embodiment of this invention a lead pollution containment box for use in a room is placed against a wall to surround a window frame to prevent hazardous lead from entering the room during window frame removal. The containment box comprises a container with sides having rear edges and front edges, the sides of the container being a top side, a bottom side, a left side and a right side, the sides having attached to their rear edge a back member to form a box, the front edge of the sides accommodate a gasket to provide a seal for said containment box. Said containment box when positioned against a wall to surround a window has attached to its bottom a vertical adjustable jack for floor support, and on its top side a brace as a ceiling support. The containment box when placed against a wall surrounding the window frame, with its gasket against the wall as a substantially airtight seal; and the adjustable jack for floor support tightened, such that the ceiling brace is securely fixed to the ceiling, the window frame can be removed in the surrounded area without contaminating the room.

The sides and back member of the containment box can be separate members and assembled to form the containment box; or the box can be an integral unit, such as made of molded plastic. As added support the containment box can be provided with an angled back brace attached to the back member to more securely fix the gasket to the wall.

A method is contemplated by this invention for removing a lead-polluted window frame from a building structure with minimum inconvenience and lead-pollution affecting the inhabitants of the building. The method comprising placing against the inside wall of the building and surrounding the window frame with a containment box. The containment box comprising a container with sides having rear edges and front edges, the sides of the container being a top side, a bottom side, a left side and a right side, with the sides having attached to their rear edge a back member to form a box. The front edge of the sides accommodate a gasket to provide a seal for said containment box. The box when positioned against a wall to surround said window frame has on its bottom side a vertical adjustable jack for floor support, and on its top side a brace as a ceiling support. The containment box being placed against said wall surrounding the window frame with the gasket against the wall to form a substantially airtight seal. The adjustable jack for floor support tightened such that the ceiling brace is securely fixed to the ceiling. Once the containment box is in place the lead polluted window frame in the surrounded area can be removed without contaminating the room. In specific application the lead polluted window frame is removed by a worker from the outside of the building structure.

In an embodiment of this invention a method is disclosed for removing a lead-paint polluted structure from the wall of a building, with the improvement comprising the steps of providing a containment means, removably installing the containment means within the building, up against the inside of the wall, and surrounding said lead-paint polluted structure in a substantially airtight manner, thereby confining any dust or debris within the containment means and preventing inadvertent pollution within the building, removing the lead-paint polluted structure while working from outside of the building, removing any dust or debris from the interior of the containment means, detoxifying the containment means, and removing the containment means for subsequent reuse thereof.

In the embodiment set forth above the lead polluted building structure can be for example, a window and window frame; or a door and door jamb. The containment means can be a containment box with a provided jackscrew for removably anchoring the containment box.

GENERAL DESCRIPTION OF THE PREFERRED EMBODIMENTS

Figure 1:
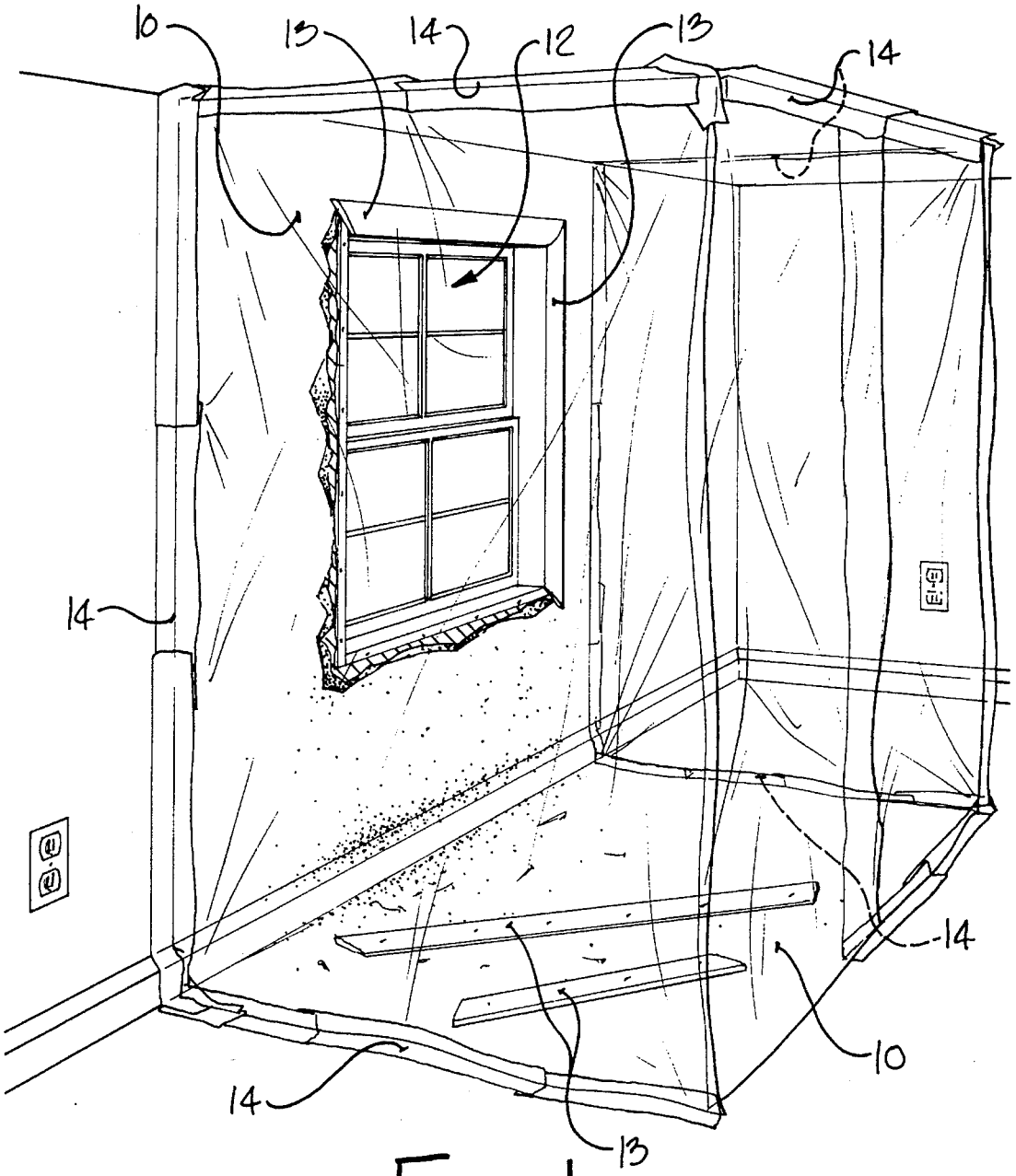
FIG. 1 PRIOR ART
FIG. 1 is a pictorial view of the prior art method using plastic for containing dust and debris from entering the living area while removing a window frame.
Figure 2:
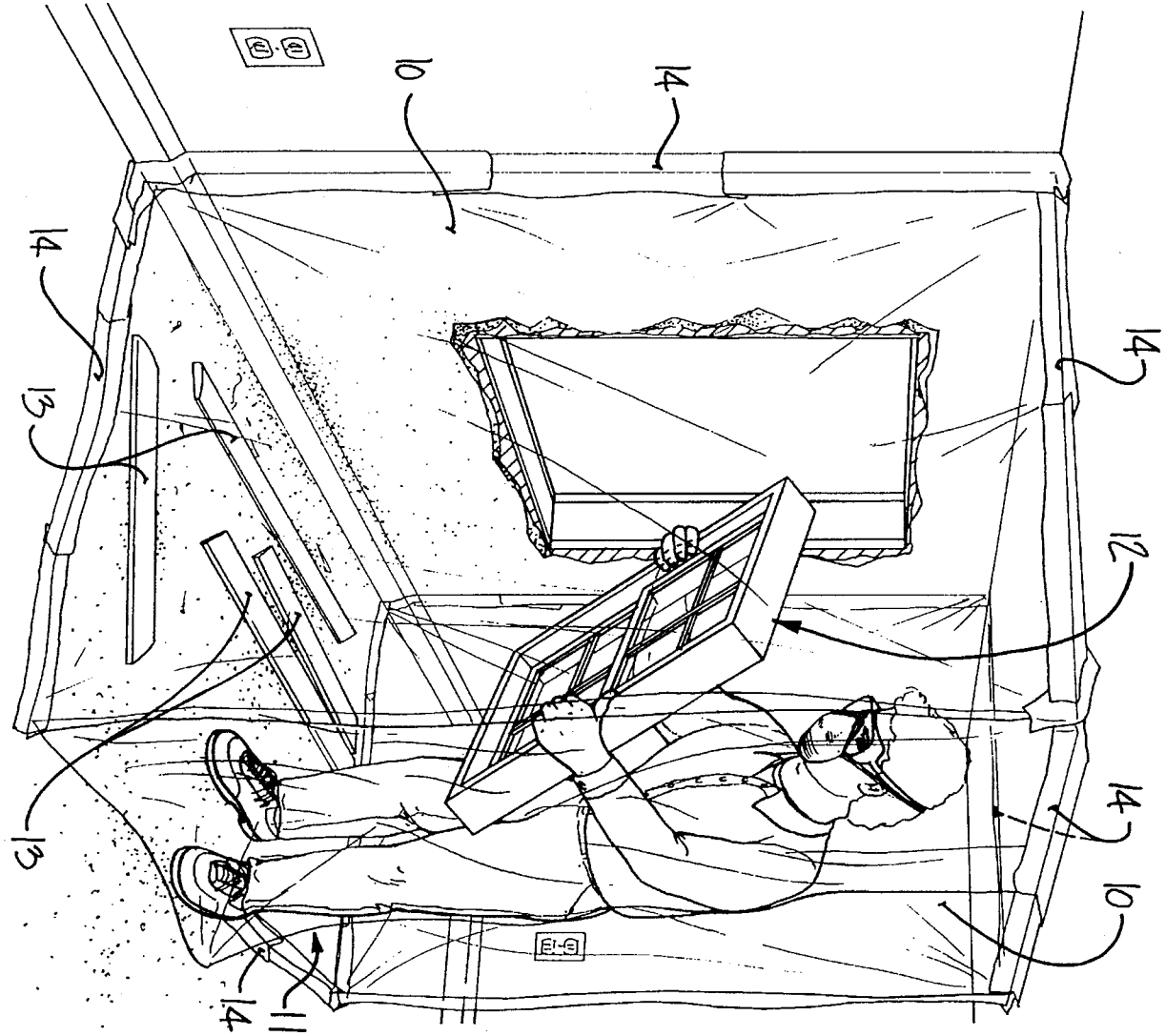
FIG. 2 PRIOR ART
FIG. 2 is a pictorial view showing the prior art plastic containment method of window and frame removal.

With reference to FIGS. 1 and 2 a plastic enclosure 10 with workman's entrance 11 surrounds the window 12 and frame 13 that is being removed, by a workman as done in the prior art. The plastic 10 is held in place by tape 14 which has the potential for marring surfaces when it is removed. And further the plastic 10 itself has the potential for being torn. Moreover, the plastic 10 has to be disposed of as a hazardous toxic material.

Figure 3:
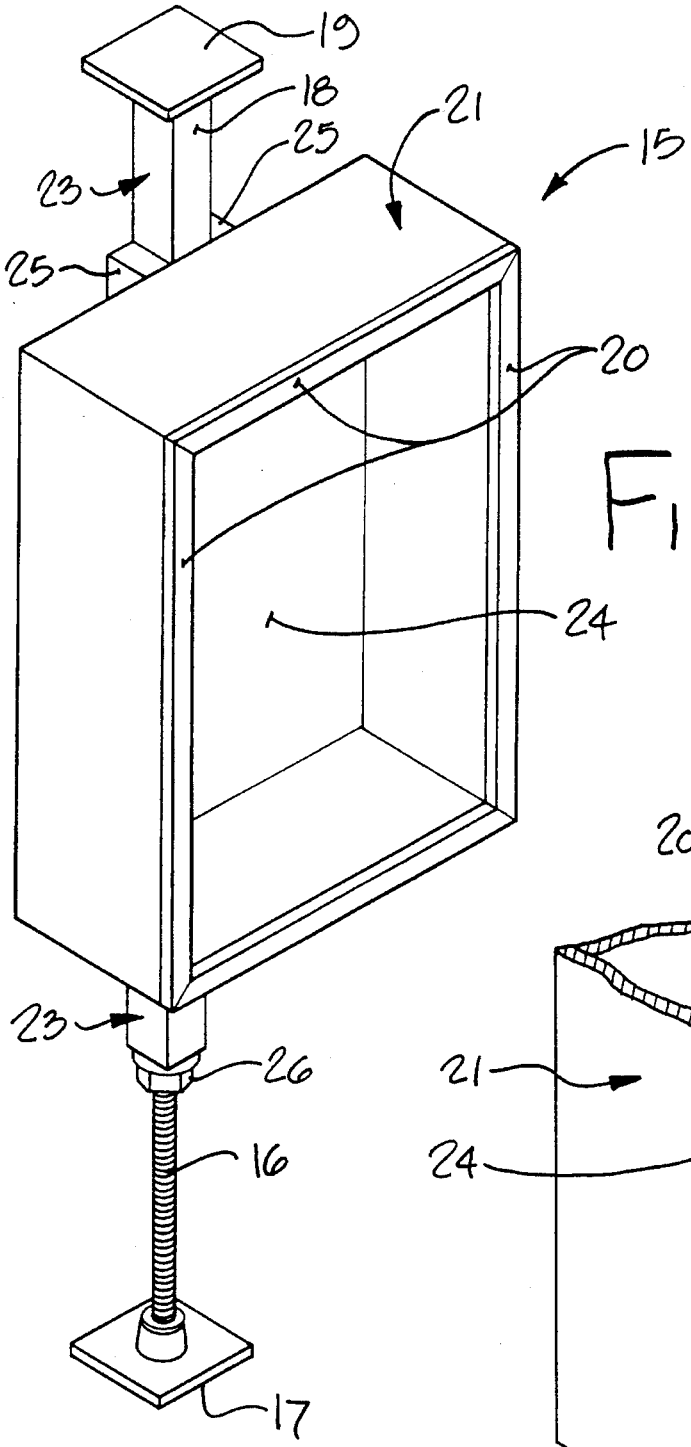
FIG. 3 is a perspective view of the containment box of this invention.

Referring to FIG. 3, the containment box of this invention 15 has a jackscrew 16 and floor pad 17 to engage the floor and a vertical brace 18 and ceiling pad 19 for ceiling support. A foam gasket 20, such as a soft polyurethane foam, surrounds front edge of the box 21 and serves to form a seal against irregular surface areas of the wall against which the containment box is to be placed. The jackscrew 16 is supported on a floor pad 17 and the vertical ceiling brace 18 is fixed to a ceiling pad 19.

Figure 3A:
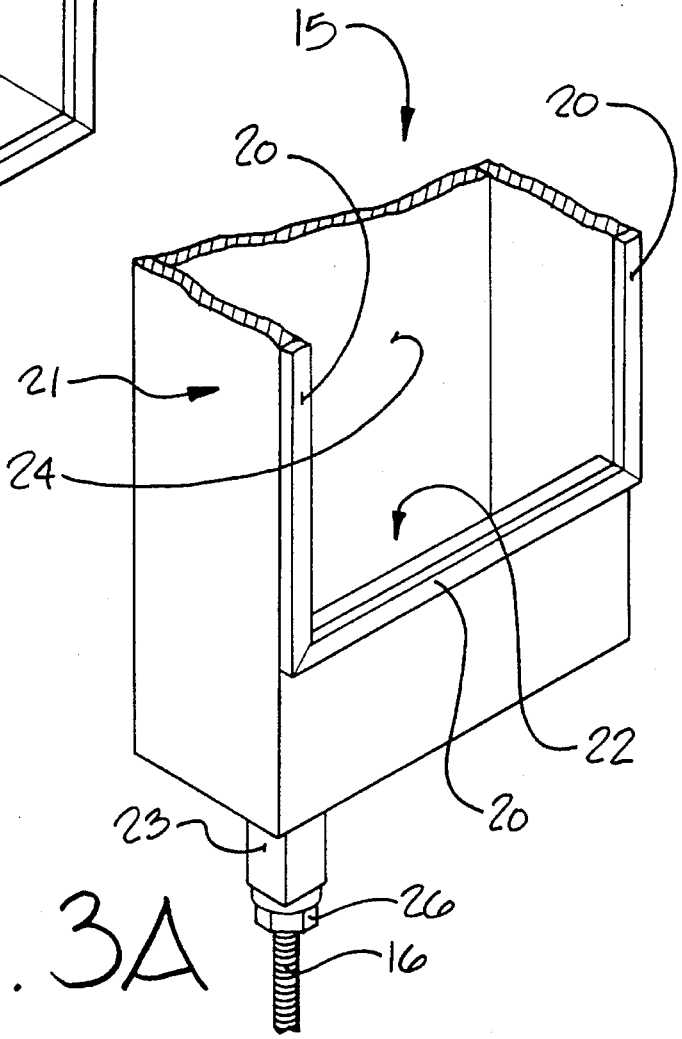
FIG. 3A is a perspective view of a modification of the containment box showing a debris capture compartment. The top of the containment box and jackscrew have been broken away for ease of illustration.

A modification of the containment box 15 (FIG. 3A) has a debris capture compartment 22 for capturing falling debris.

A back support 23 (FIGS. 4 and 6) is fixed to the back 24 of the containment box 15 by screws or other fasteners (not shown) which can assure substantial air-tightedness of the containment box 15. The jackscrew 16 and ceiling brace 18 are attached to the back support 23. The back support 23 has attached towards its bottom a support block 25 for providing added support for maintaining the containment box 15.

Figure 4:
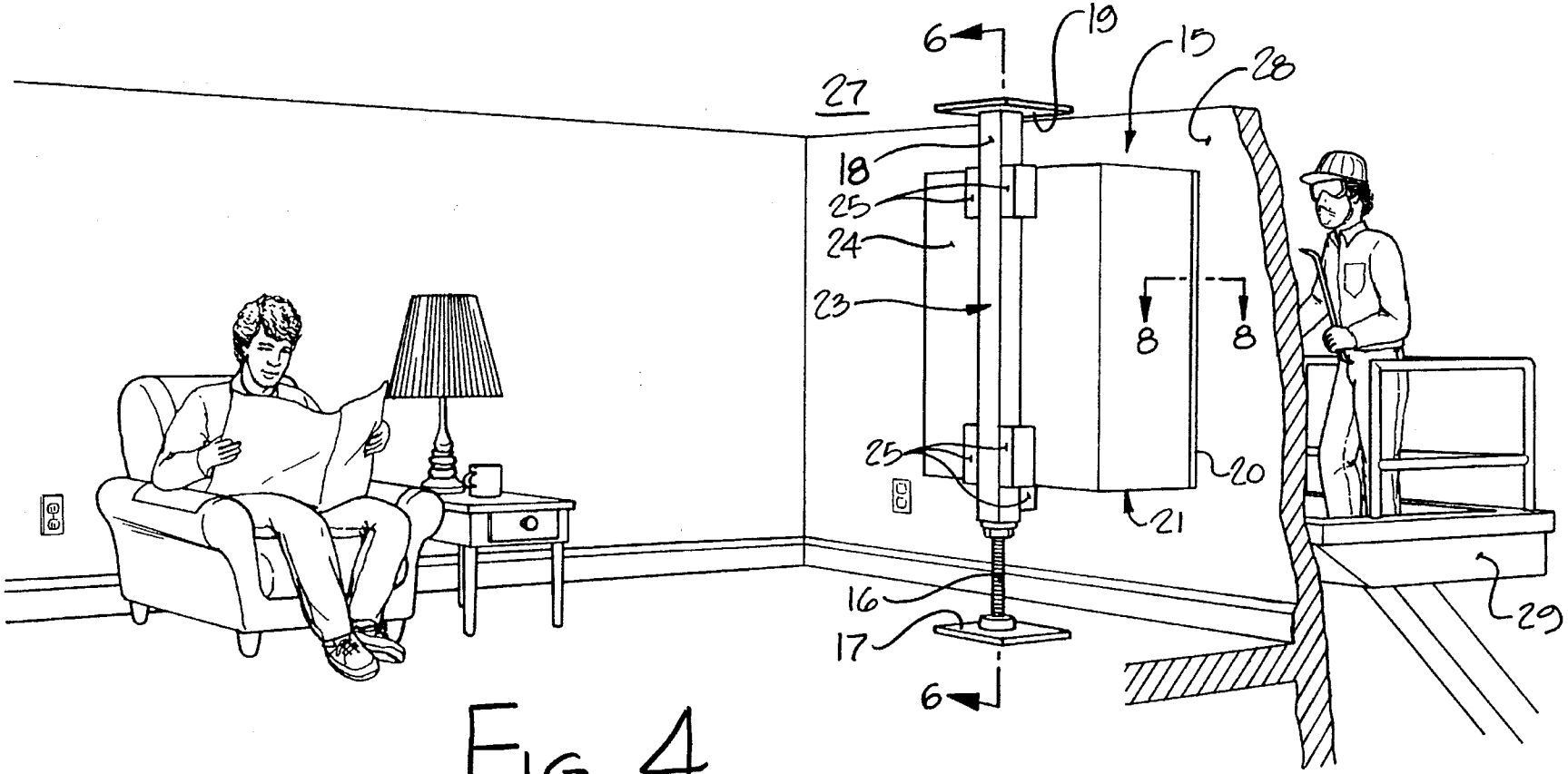
FIG. 4 is a pictorial view of the containment box viewed from inside living area of the building. Part of the wall is shown broken away to show the worker outside of the building about to remove the window frame.

The containment box 15 can be emplaced and a window frame (not shown) removed while people inhabit the building or room (FIG. 4).

Figure 5:
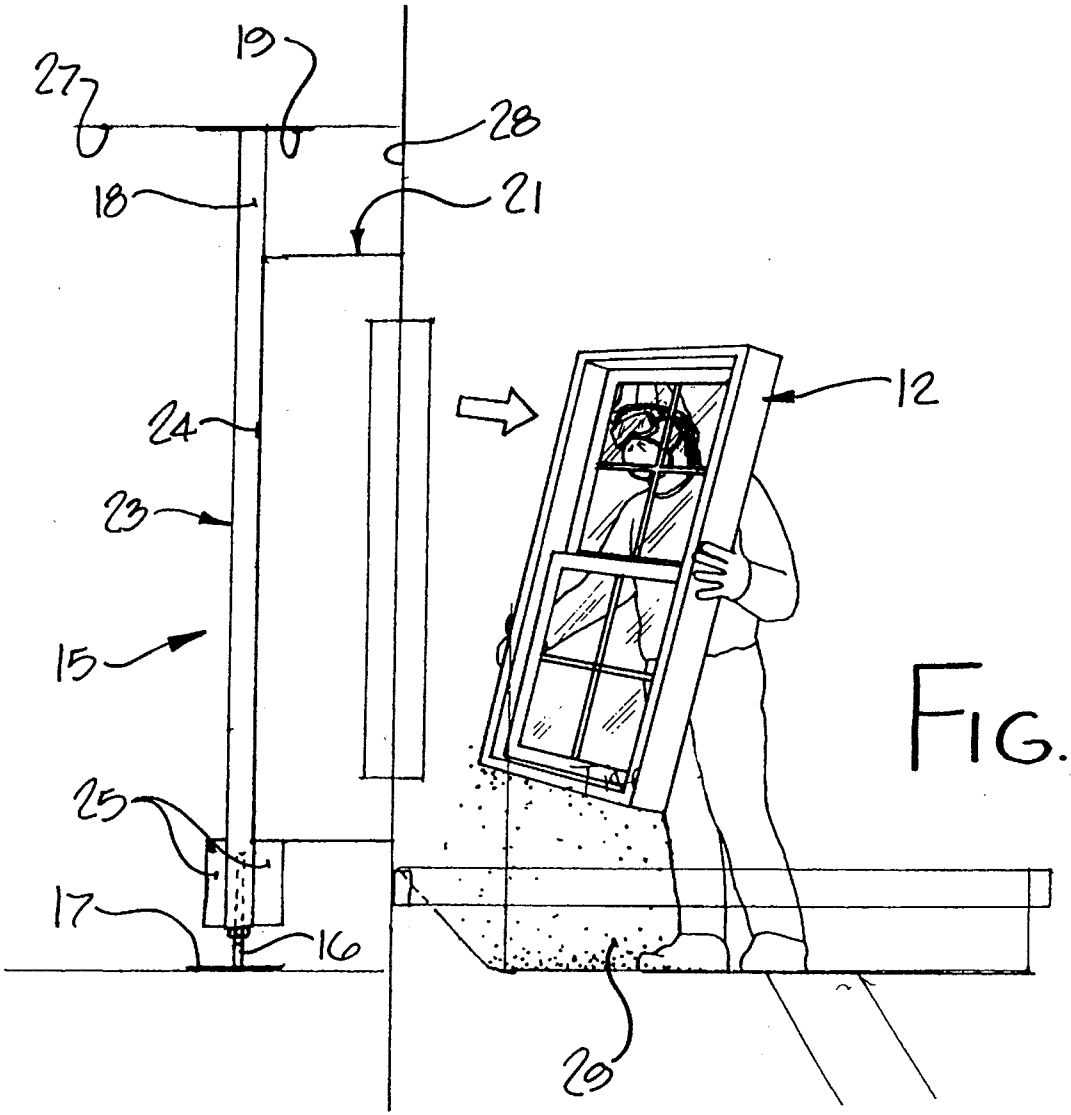
FIG. 5 is a view illustrating the workman outside the building removing the window.

A workman on the outside of the building can remove the window frame 13 (FIGS. 4 and 5) while the living area of the building is inhabited.

Figure 8:
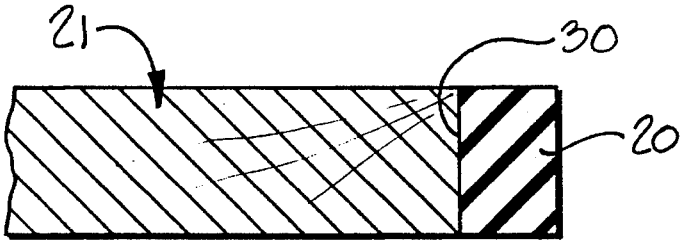
FIG. 8 is an enlarged longitudinal sectional view of the edge of the containment box taken along lines 8—8 of FIG. 4.
Figure 9:
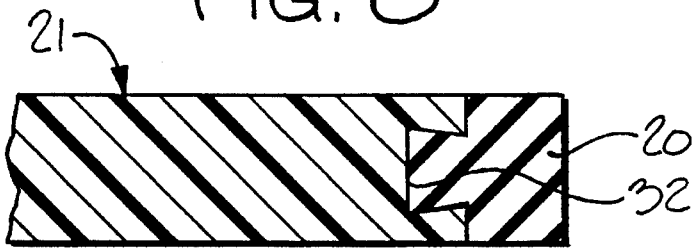
FIG. 9 is an enlarged alternative embodiment of the edge of the containment box taken along lines 8—8 of FIG. 4.

The jackscrew 16 (FIG. 4 shown in detail in FIG. 7) with a turnbuckle nut 26 and floor pad 17 are attached to the bottom of the back support 22 and used to tightened the ceiling brace 18 to the ceiling 27. The containment box 15 is emplaced with a jackscrew 16 (shown in detail in FIG. 7) tightening the ceiling brace 18 against the ceiling 27 and the foam gasket 20 (shown in detail in FIGS. 8 and 9) against the wall 28 to form a substantially airtight occlusion between the containment box 15 and the wall 28.

Figure 6:
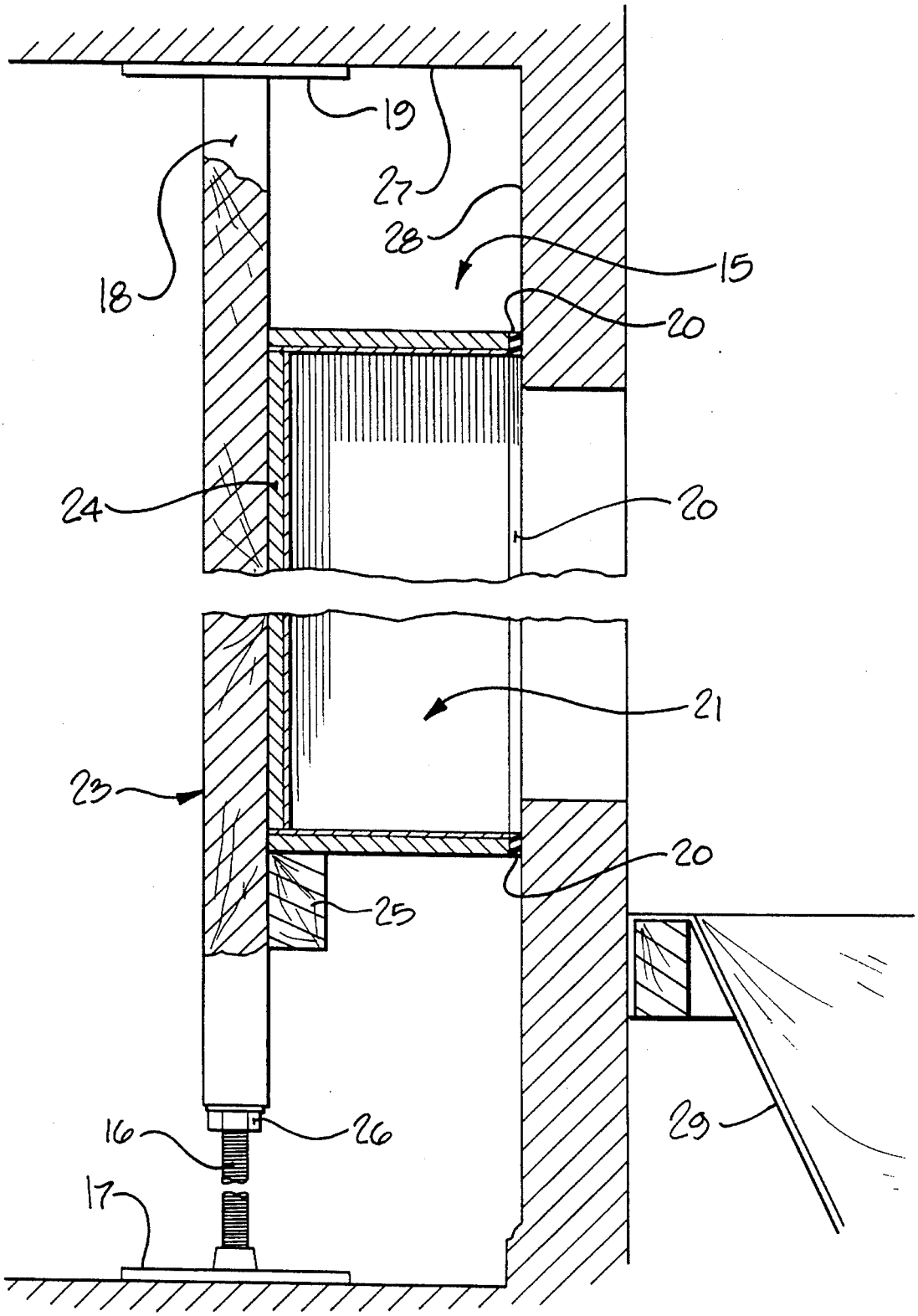
FIG. 6 is a cross-sectional view of the containment box taken along lines 6—6 of FIG. 4 with part of the box and jackscrew being broken away for ease of illustration. Part of the outside standing platform is shown.
Figure 6A:
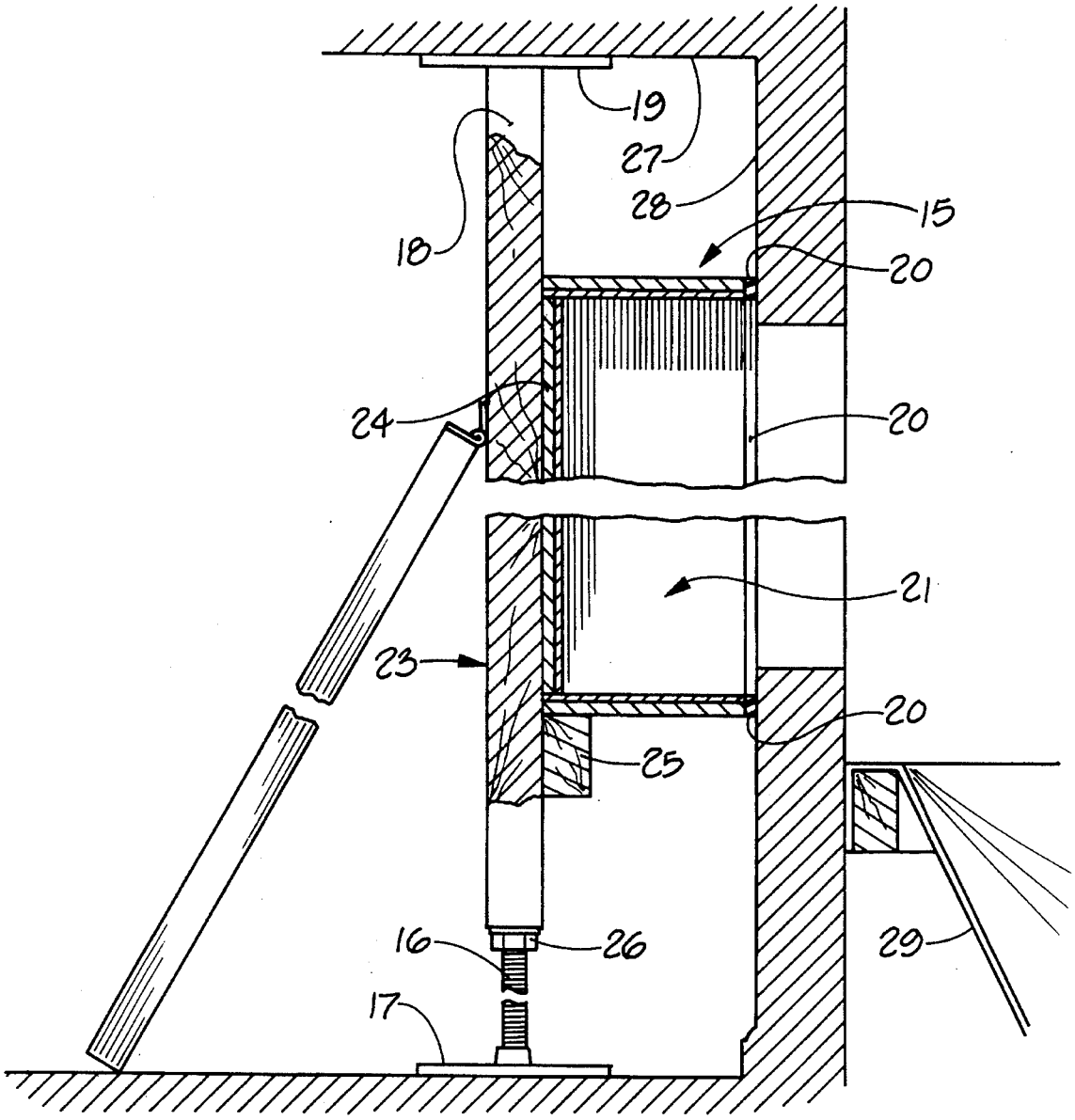
FIG. 6A is a view corresponding to FIG. 6 and showing the back brace for the containment box.

With reference to FIG. 6 the containment box 15 is positioned against the wall 28. The gasket 20 forms a seal between the wall 28 and containment box 15. The ceiling brace 18 is fixed to the ceiling 27 by adjusting the jackscrew 16. A worker (not shown) can remove the window frame 13 by standing on the platform 29 outside of the building.

Figure 7:
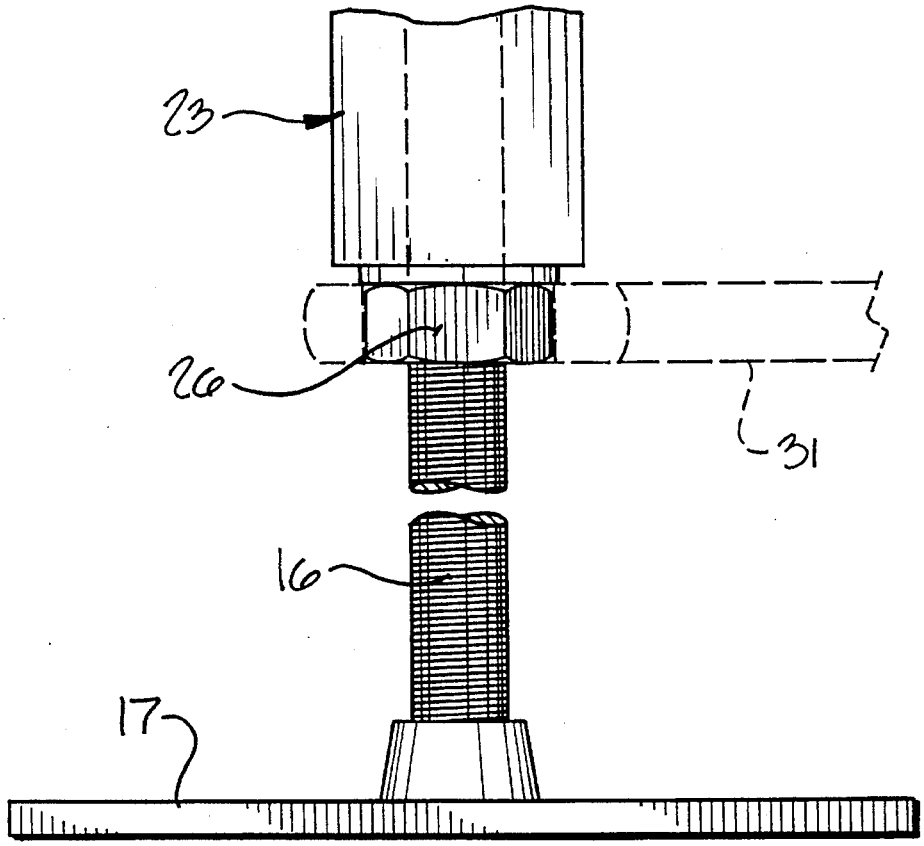
FIG. 7 is an enlarged elevational view of the containment box jackscrew. The wrench for tightening the jackscrew on the containment box is shown in dashed lines.

Referring to FIG. 7 the jackscrew 16 is fitted to a floor pad 17 and a turnbuckle nut 26 is used to tighten the ceiling brace 18 to the ceiling 27 with wrench 31 (shown-in dashed lines).

The foam edge or gasket 20 (FIG. 8) of the containment box 15 can be attached by glue 30 or for example by nails or screws (not shown), so long as the containment box 15 remains substantially airtight; or as an alternative embodiment (FIG. 9) can be attached to a plastic containment box by a dove-tail joint 32.

There are many advantages attendant to the use of the containment box of this invention.

Employing the containment box of this invention, while structural modifications are taking place, occupants of the building do not have to move out to a hotel, etc., which can be expensive. The inhabitants can remain at home while the windows and frames are removed and replaced.

In many instances a new window frame is not available and the replacement of the removed window frame cannot be done for several days. In that event, the containment box can be left in place for these several days. This protects the inside of the apartment or other inhabited spaces against the weather. In addition the containment box left in place is effective for providing security. Once the new window is installed the containment box can be removed.

With the containment box and method of this invention the operator can remove three or four times as many windows as the prior art methods used in industry.

Most importantly, with the use of the disclosed invention the occupants are not exposed to toxic lead or other pollutants; and furniture, which does not have to be moved out of the area, remains clean.

A most significant feature of this invention is the fact that the containment box is easy to install and easy to remove.

The fact that the box after detoxification, unlike plastic sheeting, can be used over and over again is a major benefit accruing from the use of this device.

Unlike plastic, the containment box of this invention does not present a disposal problem; and secondly, there is not the problem of having to repair torn plastic; and finally, and most significantly, plastic has to be taped to walls, ceiling and floor, which is time consuming and equally important is the fact that tape application is liable to leave marks or remove paint on the wall surface when it is removed.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A lead pollution containment box for use in a room, the containment box being placed against a wall to surround a window frame to prevent hazardous lead from entering the room during window frame removal, comprising a container with sides having rear edges and front edges, the sides of the container being a top side, a bottom side, a left side and a right side, the sides having attached to their rear edge a back member to form a box, and to their front edge a gasket to provide a seal for said containment box, said containment box when positioned against a wall to surround said window frame has attached to its bottom a vertical adjustable jack for floor support, and on its top side a brace as a ceiling support, the containment box, when placed against a wall surrounding the window frame, with the gasket against the wall as a substantially airtight seal, and the adjustable jack for floor support tightened, such that the ceiling brace is securely fixed to the ceiling, allowing the window frame to be removed in the surrounded area without contaminating the room.

2. The lead pollution containment box of claim 1 wherein the sides and back member of the containment box were separate members and have been assembled to make the box.

3. The lead pollution containment box of claim 1 wherein the sides and back member of the containment box are an integral unit.

4. The lead pollution containment box of claim 3 wherein the containment box has been made by molding.

5. The lead pollution containment box of claim 1 wherein there is attached to said back member an angled back brace to more securely fix the containment box gasket to the wall.

6. The lead pollution containment box of claim 1 wherein the containment box at its bottom has a debris capture compartment.

7. A method for removing a lead-polluted window frame from a building structure with minimum inconvenience and lead-pollution affecting the inhabitants of the building comprising placing against the inside wall of the building and surrounding said window frame a containment box comprising a container with sides having rear edges and front edges, the sides of the container being a top side, a bottom side, a left side and a right side, the sides having attached to their rear edge a back member to form a box, and to their front edge a gasket to provide a seal for said containment box, said box when positioned against a wall to surround said window frame has on its bottom side a vertical adjustable jack for floor support, and on its top side a brace as a ceiling support, the containment box being placed against a wall surrounding said window frame with the gasket against the wall as a substantially airtight seal, the adjustable jack for floor support such that the ceiling brace is securely fixed to the ceiling, and removing the lead polluted window frame in the surrounded area without contaminating the room.

8. The method of claim 7 wherein the sides and back of the containment box were separate members and have been assembled to make the box.

9. The method of claim 7 wherein the sides and back of the containment box are an integral unit.

10. The method of claim 7 wherein the containment box has been made by molding.

11. The method of claim 7 wherein the lead polluted window frame is removed by a worker on the outside of the building structure.

12. In the method of removing a lead polluted structure from the wall in a building, the improvement comprising the steps of providing a containment means, removably installing the containment means within the building, up against the inside of the wall, and surrounding said lead polluted structure in a substantially airtight manner, thereby confining any dust or debris within the containment means and preventing inadvertent pollution within the building, removing the lead polluted structure while working from outside of the building, removing any dust or debris from the interior of the containment means, detoxifying the containment means, and removing the containment means for subsequent reuse thereof.

13. The improvement of claim 12, wherein the lead polluted building structure comprises a window and window frame.

14. The improvement of claim 12, wherein the lead polluted building structure comprises a door and door jamb.

15. The improvement of claim 12, wherein the containment means comprises a containment box.

16. The improvement of claim 15, wherein at least one jackscrew is provided for removably anchoring the containment box.

* * * * *